US005197302A

United States Patent [19]

Sabin et al.

[11] Patent Number: 5,197,302

[45] Date of Patent: * Mar. 30, 1993

[54] VACUUM INSULATED SORBENT-DRIVEN REFRIGERATION DEVICE

[75] Inventors: Cullen M. Sabin, San Diego; Dennis A. Thomas, Los Angeles; Gary V. Steidl, Encinitas, all of Calif.

[73] Assignee: International Thermal Packaging, Inc., Westlake Village, Calif.

[ * ] Notice: The portion of the term of this patent subsequent to Sep. 17, 2008 has been disclaimed.

[21] Appl. No.: 639,036

[22] Filed: Jan. 8, 1991

Related U.S. Application Data

[63] Continuation of Ser. No. 539,330, Jun. 13, 1990, Pat. No. 5,048,301, which is a continuation of Ser. No. 293,812, Jan. 5, 1989, abandoned.

[51] Int. Cl.[5] ..... F25B 17/00

[52] U.S. Cl. ..... 62/477; 62/101

[58] Field of Search ..... 62/101, 476, 480, 477, 62/479, 103

[56] References Cited

U.S. PATENT DOCUMENTS

| | | | |
|---|---|---|---|
| 1,669,292 | 8/1923 | Van Platen . | |
| 2,144,441 | 1/1939 | Schlumbohm . | |
| 2,871,674 | 2/1959 | Koivisto et al. | 62/480 X |
| 3,229,478 | 1/1966 | Alonso . | |
| 3,309,890 | 3/1967 | Barnett . | |
| 3,316,736 | 5/1967 | Biermann . | |
| 3,373,581 | 3/1968 | Strader . | |
| 3,494,142 | 2/1970 | Beck . | |
| 3,520,148 | 7/1970 | Fuerle . | |
| 3,726,106 | 4/1973 | Jaeger . | |
| 3,759,060 | 9/1973 | Chase . | |
| 3,881,321 | 5/1975 | Riley . | |
| 3,950,960 | 4/1976 | Kawam . | |
| 3,967,465 | 7/1976 | Asselman et al. . | |
| 3,970,068 | 7/1976 | Sato . | |
| 4,205,531 | 6/1980 | Brunberg et al. . | |
| 4,250,720 | 2/1981 | Siegel . | |
| 4,640,102 | 2/1987 | Tenenbaum . | |
| 4,682,476 | 7/1987 | Payre et al. . | |
| 4,736,599 | 4/1988 | Siegel . | |
| 4,784,678 | 11/1988 | Rudick . | |
| 4,802,343 | 2/1989 | Rudick et al. . | |
| 4,911,740 | 3/1990 | Schieder . | |
| 4,974,419 | 12/1990 | Sabin et al. . | |
| 5,048,301 | 9/1991 | Sabin et al. | 62/101 |

FOREIGN PATENT DOCUMENTS 2095386 9/1982 United Kingdom .

*Primary Examiner*—Henry Bennett

[57] ABSTRACT

Disclosed is a self-contained, rapid cooling device that retains heat produced from the cooling process and can be stored for indefinite periods without losing its cooling potential. A liquid in a first chamber undergoes a change of phase into vapor which cools the first chamber. A second chamber forms a vacuum insulation about a third chamber which contains a sorbent. The sorbent in the third chamber is in fluid communication with the vapor and removes the vapor from the first chamber. The device is self-contained because a material in contact with the sorbent removes the heat from the sorbent to prevent the reduction in the cooling effect produced by the first chamber. In addition, a vacuum insulation about the third chamber keeps the heated sorbent from diminishing that cooling effect.

4 Claims, 1 Drawing Sheet

VACUUM INSULATED SORBENT-DRIVEN REFRIGERATION DEVICE

This application is a continuation of U.S. patent application Ser. No. 07/539,330, filed Jun. 13, 1990, now U.S. Pat. No. 5,048,301, which is a continuation of U.S. patent application Ser. No. 07/293,812, filed Jan. 5, 1989, now abandoned.

The invention relates to temperature changing devices and, in particular, to portable or disposable food or beverage coolers.

There are many foods and beverages that may be stored almost indefinitely at average ambient temperature of 20° C.-25° C. but that should be cooled immediately before consumption. In general, the cooling of these foods and beverages is accomplished by electrically-run refrigeration units. The use of these units to cool such foods and beverages is not always practical because refrigerators generally require a source of electricity, they are not usually portable, and they do not cool the food or beverage quickly.

An alternate method for providing a cooled material on demand is to use portable insulated containers. However, these containers function merely to maintain the previous temperature of the food or beverage placed inside them, or they require the use of ice cubes to provide the desired cooling effect. When used in conjunction with ice, insulated containers are much more bulky and heavy than the food or beverage. Moreover, in many locations, ice may not be readily available when the cooling action is required.

Ice cubes have also been used independently to cool food or beverages rapidly. However, use of ice independently for cooling is often undesirable because ice may be stored only for limited periods above 0° C. Moreover, ice may not be available when the cooling action is desired.

In addition to food and beverage cooling, there are a number of other applications for which a portable cooling device is extremely desirable. These include medical applications, including cooling of tissues or organs; preparation of cold compresses and cryogenic destruction of tissues as part of surgical procedures; industrial applications, including production of cold water or other liquids upon demand; preservation of biological specimens; cooling of protective clothing; and cosmetic applications. A portable cooling apparatus could have widespread utility in all these areas.

Most attempts to build a self-contained miniaturized cooling device have depended on the use of a refrigerant liquid stored at a pressure above atmospheric pressure, so that the refrigerant vapor could be released directly to the atmosphere. Unfortunately, many available refrigerant liquids for such a system are either flammable, toxic, harmful to the environment, or exist in liquid form at such high pressures that they represent an explosion hazard in quantities suitable for the intended purpose. Conversely, other available refrigerant liquids acceptable for discharge into the atmosphere (such as carbon dioxide) have relatively low heat capacities and latent heats of vaporization. As a result, some cooling devices which release carbon dioxide are more bulky than is commercially acceptable for a portable device.

An alternate procedure for providing a cooling effect in a portable device is to absorb or adsorb the refrigerant vapor in a chamber separate from the chamber in which the evaporation takes place. In such a system, the refrigerant liquid boils under reduced pressure in a sealed chamber and absorbs heat from its surroundings. The vapor generated from the boiling liquid is continuously removed from the first chamber and discharged into a second chamber containing a desiccant or sorbent that absorbs the vapor.

The use of two chambers to produce a cooling effect around one chamber is illustrated in U.S. Pat. Nos. 4,250,720 and 4,736,599 to Siegel and Great Britain Patent No. 2,095,386 to Cleghorn, et al. These patents disclose a two-chamber apparatus connected by a tube. The Siegel patent uses water as the refrigerant liquid, while the Cleghorn, et al. patent is not limited to water. The Siegel patent envisions the use of such a cooling device to cool food or beverages. However, both systems produce heat in the absorption chamber, and the chamber must be distanced from the area cooled by the first chamber so that the cooling effect is not compromised.

Furthermore, in both the Siegel and Cleghorn, et al. patents, the rapid initial cooling effect gradually slows as a result of the decrease in temperature of the object to be cooled. None of the prior art effectively deals with the problem of heat buildup in the sorbent chamber; thus, none of the prior sorption-cooling devices are fully suitable for use in miniaturized food, beverage and other cooling systems.

Accordingly, one objective of the present invention is to provide a self-contained sorption cooling device with a means for handling heat produced in the sorbent so that the cooling effect in the evaporation chamber is not effectively diminished.

Other objectives will become apparent from the appended drawing and the following Detailed Description of the Invention.

SUMMARY OF THE INVENTION

The present invention is a self-contained cooling apparatus comprising a first chamber containing a vaporizable liquid, an evacuated second chamber, and a third chamber containing a sorbent for the liquid, wherein the second chamber substantially surrounds the third chamber so that a vacuum surrounds the third chamber. The second chamber is adapted to convey vaporized fluid between the first and the third chambers. A valve prevents fluid communication between the first and the third chambers. An actuator opens the valve to connect the first and third chambers, permitting the liquid to vaporize and permitting the vapor to pass through the second chamber into the sorbent.

By opening the valve, a drop in pressure occurs in the first chamber because the second and third chambers are evacuated. This drop in pressure causes the liquid in the first chamber to vaporize, and, because this liquid-to-gas phase change can occur only if the liquid removes heat equal to the latent heat of vaporization of the evaporated liquid from the first chamber, the first chamber cools. The vapor passes through the second chamber into the third chamber where it is absorbed and adsorbed by the sorbent. The sorbent also gains all of the heat contained in the absorbed or adsorbed vapor, and, if the absorbtion-adsorption process involves an exothermic chemical reaction, the sorbent must also absorb the reaction heat.

The heat contained within the sorbent is removed from the sorbent by a heat removing material. Preferably, that heat removing material is a phase change material which is thermally coupled to the sorbent. It has a thermal mass different from the material comprising the third chamber in contact with the sorbent and has a heat capacity greater than that of the sorbent. The heat is also contained within the third chamber by a vacuum which insulates the third chamber. In a preferred embodiment, the third chamber is mounted substantially concentrically within the second chamber, and in one embodiment the liquid vapor must flow substantially around the third chamber and into that third chamber.

In another preferred embodiment, the liquid is water. In still another, a highly hydrophilic polymer lines the interior surface of the first chamber to maximize the surface area from which boiling may occur. The liquid may be mixed with a nucleating agent that promotes ebullition of the liquid.

The present invention provides a self-contained rapid cooling device that cools a food, beverage or other material article from ambient temperature on demand in a timely manner, exhibits a useful change in temperature, retains the heat produced from the cooling process or retards the transfer of the heat from the sorbent back to the material being cooled, can be stored for unlimited periods without losing its cooling potential, and is able to meet government standards for safety in human use.

DETAILED DESCRIPTION OF THE PREFERRED EMBODIMENT

Figure 2:
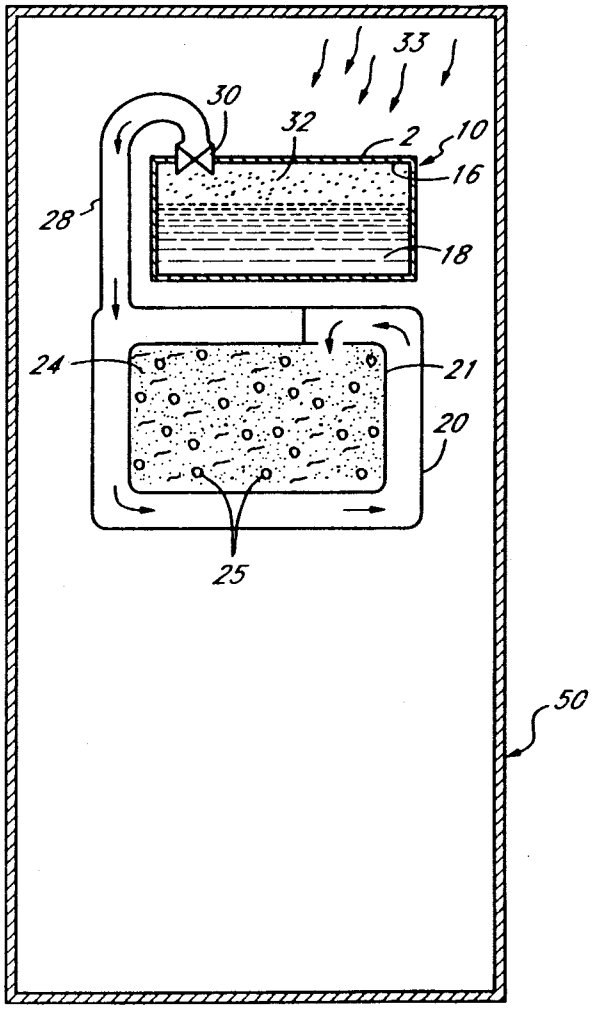
FIG. 2 is a schematic representation of a cooling device according to the present invention, wherein the second and third chambers are outside of the first chamber.

As is shown in the figures, the cooling device 10 has a first chamber 12 containing a refrigerant liquid 18 and having its interior surface coated with a wicking material 16. The cooling device 10 also includes a second chamber 20, which surrounds a third chamber 21. The third chamber 21 is at least partially filled with a sorbent 24, which is optionally in contact with a heat-removing material 25. As is schematically shown in the figures, the second chamber 20 and the third chamber 21 are in constant fluid communication. Initially, at least one of the two chambers is evacuated, thus creating a vacuum within the other.

Figure 1:
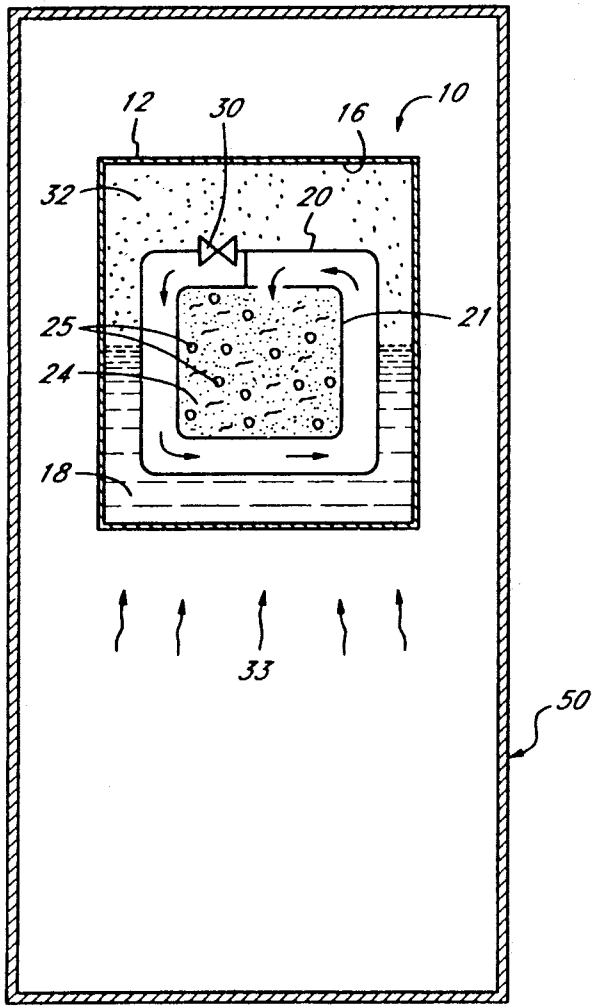
FIG. 1 is a schematic representation of a cooling device according to the present invention, wherein the second and third chambers are wholly within the first chamber.

Positioned between the first chamber 12 and the second chamber 20 is a valve 30, which allows fluid communication between the chambers 12 and 20 only when the valve 30 is open. As is shown in FIG. 2, a conduit 28 may connect the first chamber 12 and the second chamber 20 with the valve 30 interposed in the conduit 28. In a more preferred embodiment which is shown in FIG. 1, however, the second chamber 20 and thus the third chamber 21 are wholly contained within the first chamber 12 so that no conduit is needed to connect the first chamber 12 and the second chamber 20.

The operation of the cooling device 10 is suspended (i.e., the system is static and no cooling occurs) until the valve 30 is opened, at which time the conduit 28 provides fluid communication between the first, second, and third chambers, 12, 20 and 21 respectively. Opening the valve 30 between the first and second chambers 10 and 20 causes a drop in pressure in chamber 12 because the second chamber 20 is evacuated. The drop in pressure in the first chamber 12 upon opening of the valve 30 causes the liquid 18 to boil at ambient temperature into a liquid-vapor mixture 32. This liquid-to-gas phase change can occur only if the liquid 18 removes heat equal to the latent heat of vaporization of the evaporated liquid 18 from the first chamber 12. This causes the first chamber 12 to cool. The cooled first chamber 12, in turn, removes heat from its surrounding material as indicated by the arrows 33.

Once inside the third chamber 21, the vapor is absorbed or adsorbed by the sorbent 24. This facilitates the maintenance of a reduced vapor pressure in the first chamber 12 and allows more of the liquid 18 to boil and become vapor, further reducing the temperature of chamber 12. The continuous removal of the vapor maintains the pressure in the first chamber 12 below the vapor pressure of the liquid 18, so that the liquid 18 boils and produces vapor continuously until sorbent 24 is saturated, until the liquid 18 has boiled away or until the temperature of the liquid 18 has dropped below its boiling point.

When the sorbent 24 absorbs or absorbs the vapor, a heat of absorption or adsorption is generated. The optional heat-removing material 25, which is thermally coupled to the sorbent 24 (and preferably is mixed with the sorbent 24) removes heat from the sorbent 24, preventing or slowing a rise in temperature in both the sorbent 24 and the third chamber 21, which rise in temperature might compromise the cooling effect produced by the first chamber 12.

The relationship of the three chambers performs another function which prevents any compromising of the cooling effect produced by the first chamber 12. Because the second chamber 20 is substantially evacuated and surrounds the third chamber 21, it forms an insulator so that the heat contained within the third chamber 21 remains within that chamber. The vacuum insulation about the third chamber 21 inhibits that chamber from warming the cooling first chamber 12. Preferably, the third chamber 21 is mounted substantially concentrically within the second chamber 20. In one embodiment, the entrance to the third chamber 21 is positioned so that the liquid vapor must flow substantially around the third chamber 21 until it enters the third chamber 21 and is sorbed by the sorbent 24.

As is shown in FIG. 1, the aforementioned configuration allows the construction of the cooling device 10 to be miniaturized and compact. Its size can be greatly reduced by placing the second and third chambers 20 and 21 within the first chamber 12. Nevertheless, it is understood that the second and third chambers 20 and 21 can be situated alongside of the first chamber 12 as is depicted in FIG. 2 as long as the second chamber 20 insulates the third chamber 21 to prevent heat from compromising the cooling effect.

It is preferred that there is enough sorbent 24 within the third chamber 21 so that substantially all of the liquid 18 is absorbed or adsorbed in the sorbent 24. By having an excess of sorbent 24, the device ensures that a vacuum will remain in the second chamber 20 at the most critical time to ensure insulation about the third chamber 21 - after the sorption process is complete. It is also preferable that, while there may not be a complete vacuum in the second chamber 20, it is at a pressure substantially lower than atmospheric during and after evaporation so that a substantial vacuum exists to insulate about the third chamber 21.

Two important components of the present invention are the evaporating liquid and the sorbent. The liquid and the sorbent must be complimentary (i.e., the sorbent must be capable of absorbing or adsorbing the vapor produced by the liquid), and suitable choices for these components would be any combination able to make a useful change in temperature in a short time, meet government standards for safety and be compact.

The refrigerant liquids used in the present invention preferably have a high vapor pressure at ambient temperature, so that a reduction of pressure will produce a high vapor production rate. The vapor pressure of the liquid at 20° C. is preferably at least about 9 mm Hg, and more preferably is at least about 15 or 20 mm Hg. Moreover, for some applications (such as cooling of food products), the liquid should conform to applicable government standards in case any discharge into the surroundings, accidental or otherwise, occurs. Liquids with suitable characteristics for various uses of the invention include: various alcohols, such as methyl alcohol and ethyl alcohol; ketones or aldehydes, such as acetone and acetaldehyde; water; and freons, such as freon C318, 114, 21, 11, 114B2, 113 and 112. The preferred liquid is water.

In addition, the refrigerant liquid may be mixed with an effective quantity of a miscible nucleating agent having a greater vapor pressure than the liquid to promote ebullition so that the liquid evaporates even more quickly and smoothly, and so that supercooling of the liquid does not occur. Suitable nucleating agents include ethyl alcohol, acetone, methyl alcohol, propyl alcohol and isobutyl alcohol, all of which are miscible with water. For example, a combination of a nucleating agent with a compatible liquid might be a combination of 5% ethyl alcohol in water or 5% acetone in methyl alcohol. The nucleating agent preferably has a vapor pressure at 25° C. of at least about 25 mm Hg and, more preferably, at least about 35 mm Hg. Alternatively, solid nucleating agents may be used, such as the conventional boiling stones used in chemical laboratory applications.

The sorbent material used in the third chamber 21 is preferably capable of absorbing and adsorbing all the vapor produced by the liquid, and also preferably will meet government safety standards for use in an environment where contact with food may occur. Suitable sorbents for various applications may include barium oxide, magnesium perchlorate, calcium sulfate, calcium oxide, activated carbon, calcium chloride, glycerine, silica gel, alumina gel, calcium hydride, phosphoric anhydride, phosphoric acid, potassium hydroxide, sulphuric acid, lithium chloride, ethylene glycol and sodium sulfate.

The heat-removing material may be one of three types: (1) a material that undergoes a change of phase when heat is applied; (2) a material that has a heat capacity greater than the sorbent; or (3) a material that undergoes an endothermic reaction when brought in contact with the liquid refrigerant.

Suitable phase change materials for particular applications may be selected from paraffin, naphthalene, sulphur, hydrated calcium chloride, bromocamphor, cetyl alcohol, cyanimide, eleudic acid, lauric acid, hydrated sodium silicate, sodium thiosulfate pentahydrate, disodium phosphate, hydrated sodium carbonate, hydrated calcium nitrate, Glauber's salt, potassium, sodium and magnesium acetate. The phase change materials remove some of the heat from the sorbent material simply through storage of sensible heat. In other words, they heat up as the sorbent heats up, removing heat from the sorbent. However, the most effective function of the phase change material is in the phase change itself. An extremely large quantity of heat can be absorbed by a suitable phase change material in connection with the phase change (i.e., change from a solid phase to a liquid phase, or change from a liquid phase to a vapor phase). There is typically no change in the temperature of the phase change material during the phase change, despite the relatively substantial amount of heat required to effect the change, which heat is absorbed during the change. Phase change materials which change from a solid to a liquid, absorbing from the sorbent their latent heat of fusion, are the most practical in a closed system. However, a phase change material changing from a liquid to a vapor is also feasible. Thus, an environmentally-safe liquid could be provided in a separate container (not shown) in contact with the sorbent material (to absorb heat therefrom) but vented in such a way that the boiling phase change material carries heat away from the sorbent material and entirely out of the system.

Another requirement of any of the phase change materials is that they change phase at a temperature greater than the expected ambient temperature of the material to be cooled, but less than the temperature achieved by the sorbent material upon absorption of a substantial fraction (i.e., one-third or one-quarter) of the refrigerant liquid. Thus, for example, in most devices according to the present invention which are intended for use in cooling a material such as a food or beverage, the phase change material could change phase at a temperature above about 30° C., preferably above about 35° C. but preferably below about 70° C., and most preferably below about 60° C. Of course, in some applications, substantially higher or lower phase change temperatures may be desirable. Indeed, many phase change materials with phase change temperatures as high as 90° C., 100° C. or 110° C. may be appropriate in certain systems.

Materials that have a heat capacity greater than that of the sorbent simply provide a thermal mass in contact with the sorbent that does not effect the total amount of heat in the system, but reduces the temperature differential between the material being cooled and the third chamber 21, with two results. First, the higher the temperature gradient between two adjacent materials, the more rapid the rate of heat exchange between those two materials, all else being equal. Thus, such thermal mass materials in the third chamber 21 slow the transfer of heat out of the third chamber 21. Second, many sorbent materials function poorly or do not function at all when the temperature of those materials exceeds a certain limit. Heat-absorbing material in the form of a thermal mass can substantially reduce the rate of the sorbent's temperature increase during the cooling cycle. This, in turn, maintains the sorbent at a lower temperature and facilitates the vapor-sorption capabilities of the sorbent. Various materials which have a high specific heat include cyanimide, ethyl alcohol, ethyl ether, glycerol, isoamyl alcohol, isobutyl alcohol, lithium hydride, methyl alcohol, sodium acetate, water, ethylene glycol and paraffin wax.

Care must be taken, of course, when selecting a high specific heat material (or high thermal mass material) to ensure that it does not interfere with the functioning of the sorbent. If the heat-absorbing material, for example, is a liquid, it may be necessary to package that liquid or otherwise prevent physical contact between the heat-absorbing material and the sorbent. Small individual containers of heat-absorbing material scattered throughout the sorbent may be utilized when the sorbent and the heat-absorbing material cannot contact one another. Alternatively, the heat-absorbing material may be placed in a single package having a relatively high surface area in contact with the sorbent to facilitate heat transfer from the sorbent into the heat-absorbing material.

The third category of heat-removing material (material that undergoes an endothermic reaction) has the advantage of completely removing heat from the system and storing it in the form of a chemical change. The endothermic material may advantageously be a material that undergoes an endothermic reaction when it comes in contact with the refrigerant liquid (or vapor). In this embodiment of the invention, when the valve 30 in the conduit 28 is opened, permitting vapor to flow through the conduit 28 into the third chamber 21, the vapor comes in contact with some of the endothermic material, which then undergoes an endothermic reaction, removing heat from the sorbent 24. Such endothermic materials have the advantage that the heat is more or less permanently removed from the sorbent, and little, if any, of that heat can be retransferred to the material being cooled. This is in contrast to phase change materials and materials having a heat capacity greater than the sorbent material, both of which may eventually give up their stored heat to the surrounding materials, although such heat exchange (because of design factors that retard heat transfer, such as poor thermal conductivity of the sorbent 24) generally does not occur with sufficient rapidity to reheat the cooled material prior to use of that material.

Heat-absorbing materials which undergo an endothermic reaction may variously be selected from such compounds as $H_2BO_3$, $PbBr_2$, $KBrO_3$, $KClO_3$, $K_2Cr_2O_7$, $KClO_4$, $K_2S$, $SnI_2$, $NH_4Cl$, $KMnO_4$ and $CsClO_4$. Furthermore, the heat-removing material may be advantageously in contact with the sorbent. In various embodiments of the invention, the sorbent and heat-removing material could be blended, the heat-removing material could be in discrete pieces mixed with the sorbent, or the material could be a mass in contact with, but not mixed into, the sorbent.

In selecting the wicking material 16, any of a number of materials may be chosen, depending upon the requirements of the system and the particular refrigerant liquid 18 being used. The wicking material may be something as simple as cloth or fabric having an affinity for the refrigerant liquid 18 and a substantial wicking ability. Thus, for example, when the refrigerant liquid is water, the wicking material may be cloth, sheets, felt or flocking material which may be comprised of cotton, filter material, natural cellulose, regenerated cellulose, cellulose derivatives, blotting paper or any other suitable material.

The most preferred wicking material would be highly hydrophilic, such as gel-forming polymers which would be capable of coating the interior surface of the evaporation chamber. Such materials preferably consist of alkyl, aryl and amino derivative polymers of vinylchloride acetate, vinylidene chloride, tetrafluoroethylene, methyl methacrylate, hexanedoic acid, dihydro-2,5-furandione, propenoic acid, 1,3-isobenzofurandione, 1 h-pyrrole-2,5-dione or hexahydro-2 h-azepin-2-one.

The wicking material may be sprayed, flocked, or otherwise coated or applied onto the interior surface of the first chamber 12. In a preferred embodiment, the wicking material is electrostatically deposited onto that surface. In another embodiment, the wicking material is mixed with a suitable solvent, such as a non-aqueous solvent, and then the solution is applied to the interior surface of the first chamber 12.

In another preferred embodiment, the wicking material is able to control any violent boiling of the evaporator and thus reduces any liquid entrainment in the vapor phase. In such an embodiment, the wicking material is a polymer forming a porous space-filling or sponge-like structure, and it may fill all or part of the first chamber 12.

The valve 30 may be selected from any of the various types shown in the prior art. The valve 30 may be located at any location between the first chamber 14 and the third chamber 21 so long as it prevents vapor from being sorbed by the sorbent 24. However, if the entire cooling device 10 is within a pressurized container 50, a pressure responsive valve can be used which can actuate the cooling device upon the release of the pressure within the container.

The invention also includes a method of using the cooling device described herein. This method includes the step of providing a cooling device of the type set forth herein; opening the valve between the first chamber 12 and the second chamber 20, whereby the pressure in the first chamber is reduced, causing the liquid to boil, forming a vapor, which vapor is collected by the sorbent material; removing vapor from the second chamber by collecting the same in the sorbent until an equilibrium condition is reached wherein the sorbent is substantially saturated or substantially all of the liquid originally in the first chamber has been collected in the sorbent; and simultaneously removing heat from the sorbent by means of the heat-removing material described above. The process is preferably a one-shot process; thus, opening of the valve 30 in the conduit 28 connecting the first chamber 12 and the second chamber 20 is preferably irreversible. At the same time, the system is a closed system; in other words, the refrigerant liquid does not escape the system, and there is no means whereby the refrigerant liquid or the sorbent may escape either the first chamber 12 or the second chamber 20.

Although the invention has been described in the context of certain preferred embodiments, it is intended that the scope of the invention not be limited to the specific embodiment set forth herein, but instead be measured by the claims that follow.

What is claimed is:

1. A self-contained cooling device, comprising:

a liquid that, in operation of the device, evaporates to form a vapor;

a first chamber containing a sorbent for receiving the vapor;

a second chamber into which said liquid evaporates during operation of said cooling device, and second chamber substantially surrounding and thermally enclosing the first chamber, the second chamber adapted to serve as a thermal insulator of the first chamber when the second chamber is substantially evacuated; and means for preventing flow of vapor into said first chamber until commencement of operation of said cooling device.

2. The device of claim 1, wherein said means for preventing flow is a valve.

3. The device of claim 1, wherein said valve is a pressure responsive valve.

4. A self-contained cooling device, comprising:

a liquid that, in operation of the device, evaporates to form a vapor;

a first chamber containing a sorbent for receiving the vapor;

a second chamber substantially surrounding and thermally enclosing the first chamber, the second chamber adapted to serve as a thermal insulator of the first chamber when the second chamber is substantially evacuated, the second chamber being further adapted to serve as a conduit for passage of the vapor into the first chamber; and means for preventing flow of vapor into said first chamber until commencement of operation of said cooling device.

* * * * *